US008803104B2

(12) United States Patent
Ducimetiere et al.

(10) Patent No.: US 8,803,104 B2
(45) Date of Patent: Aug. 12, 2014

(54) IONIZATION CELL FOR A MASS SPECTROMETER, AND CORRESPONDING LEAK DETECTOR

(75) Inventors: Laurent Ducimetiere, Annecy (FR); Cyrille Nomine, Annecy (FR); Jean-Eric Larcher, Delle (FR)

(73) Assignee: Adixen Vacuum Products, Annecy (FR)

( * ) Notice: Subject to any disclaimer, the term of this patent is extended or adjusted under 35 U.S.C. 154(b) by 0 days.

(21) Appl. No.: 13/255,383

(22) PCT Filed: Mar. 10, 2010

(86) PCT No.: PCT/FR2010/050407

§ 371 (c)(1), (2), (4) Date: Sep. 8, 2011

(87) PCT Pub. No.: WO2010/103235

PCT Pub. Date: Sep. 16, 2010

(65) Prior Publication Data

US 2011/0315875 A1 Dec. 29, 2011

(30) Foreign Application Priority Data

Mar. 11, 2009 (FR) ..... 09 01114

(51) Int. Cl.
*H01J 49/14* (2006.01)
*H01J 49/26* (2006.01)

(52) U.S. Cl.
USPC ..... 250/427; 250/423 R; 250/282

(58) Field of Classification Search
USPC ..... 250/427, 423 R; 313/231.01; 315/64
See application file for complete search history.

(56) References Cited

U.S. PATENT DOCUMENTS 5,600,136 A * 2/1997 Hablanian et al. ..... 250/288
6,686,595 B2 * 2/2004 Horsky ..... 250/427
2002/0162508 A1 11/2002 Dykstra (Continued)

FOREIGN PATENT DOCUMENTS

DE 2228954 * 6/1971 ..... H01J 39/34
FR 1516614 3/1968
GB 1338213 11/1973

OTHER PUBLICATIONS

International Search Report for PCT/FR2010/050407 dated Jun. 23 2010.

(Continued)

*Primary Examiner* — Jack Berman
*Assistant Examiner* — Kevin Chung
(74) *Attorney, Agent, or Firm* — Sughrue Mion, PLLC

(57) ABSTRACT

An ionization cell for a mass spectrometer (2) includes: an ionization housing (10) having a first and a second electron input groove (11, 26) and one side (16) of which has an output groove (15) for passing ionized particles (14*a*, 14*b*, 14*c*) therethrough, a first working filament (13) placed opposite the first electron input groove (11) and intended to be supplied to produce an electron beam (12), and a second backup filament (22) placed opposite the second electron input groove (26) and intended to be supplied in the event the first working filament (13) fails so as to produce the electron beam, the input groove (26) being placed outside a front region (F) located opposite the first input groove (11). The invention also relates to a leak detector with a mass spectrometer, which includes such an above-described ionization cell.

11 Claims, 3 Drawing Sheets

(56) References Cited

U.S. PATENT DOCUMENTS

| | | | | |
|---|---|---|---|---|
| 2005/0133738 | A1* | 6/2005 | Joo | 250/492.21 |
| 2005/0178975 | A1* | 8/2005 | Glukhoy | 250/427 |
| 2006/0097185 | A1 | 5/2006 | Mack | |
| 2007/0187586 | A1* | 8/2007 | Geist et al. | 250/288 |

OTHER PUBLICATIONS

Holkeboer, D.H. et al, "Miniature quadrupole residual gas analyzer for process monitoring at milliTorr pressures" Journal of Vacuum Science and Technology, Part A, AVS/AIP, Melville, NY, US, vol. 16, No. 3 May 1 1998, pp. 1157-1162 XP012003915.

* cited by examiner

IONIZATION CELL FOR A MASS SPECTROMETER, AND CORRESPONDING LEAK DETECTOR

BACKGROUND OF THE INVENTION

The present invention relates to an ionization cell for a mass spectrometer. In particular, the invention is applicable to mass spectrometers in which a heated electrical filament emits electrons. The invention also relates to a leak detector comprising the ionization cell.

In a mass spectrometer a gaseous sample is analyzed by bombarding the sample with a flux of electrons and then making the ionized particles thus obtained move so as to then differentiate them for example depending on their trajectory. The mass spectrometers of leak detectors thus measure and quantify a tracer gas, such as helium.

Mass spectrometers comprise for example an ionization cell containing an ionization cage and a heating electric filament that emits electrons. The molecules of the gas to be analyzed are bombarded by the electron beam and a substantial part of the molecules of the gas to be analyzed is converted into ionized particles. These ionized particles are then accelerated by an electric field. They then arrive in a zone containing a magnetic field, which has the property of altering the trajectories of the ionized particles as a function of their mass. The current of ionized particles of the tracer gas is proportional to the partial pressure of the gas in the apparatus, and its measurement allows the value of the flow rate of the detected leak to be known.

In order to make the operation of the mass spectrometer more reliable, certain ionization cells contain two filaments. A working first filament is powered to produce the electron beam and a backup second filament is intended to be powered in the event of failure of the working first filament.

However, it has been observed that the waiting time required for the backup second filament to become operational, so as to allow stable and reproducible measurement representative of the quantity of tracer gas, can prove to be excessively long (a wait of up to two hours may be necessary).

SUMMARY OF THE INVENTION

The objective of the invention is therefore to reduce the waiting time required for the ionization cell to become operational again when passing from the failed, working first filament to the backup second filament.

For this purpose, one subject of the invention is an ionization cell, for a mass spectrometer, comprising:

- an ionization cage comprising first and second electron entrance slits, and one side of which has an exit slit for the passage of ionized particles;
- a working first filament, placed facing said first electron entrance slit, intended to be powered so as to produce an electron beam; and
- a backup second filament, placed facing said second electron entrance slit and intended to be powered, in the event of failure of the working first filament, so as to produce the electron beam,
- said second entrance slit being placed outside of a frontal region facing said first entrance slit.

Specifically, the inventors have surprisingly observed that, with this arrangement of the ionization cell, the backup second filament is not altered by the operation of the working first filament.

When the failed, working first filament is switched to the backup second filament, a stable, accurate and reproducible measurement may then be rapidly obtained using the mass spectrometer immediately after the backup second filament has been sufficiently heated i.e. after about fifteen minutes of being powered. The time required to switch filament is thus significantly reduced since the backup second filament is very rapidly operational.

According to one or more features of the ionization cell, taken individually or in combination:

- the longitudinal axes of said first and said second entrance slits are substantially parallel to each other, and parallel to an edge of said ionization cage;
- said first and said second entrance slits are placed on opposite faces of said ionization cage;
- said first and said second entrance slits define a plane substantially parallel to the plane defined by the side containing the exit slit for the passage of ionized particles;
- the first and second ends of said first and said second entrance slits are contained in two planes respectively parallel to each other and parallel to a side face of the ionization cage;
- said second entrance slit is offset from the frontal region, both along an axis parallel to the longitudinal axis of said first entrance slit and along an axis perpendicular to the longitudinal axis of said first entrance slit;
- said second entrance slit is placed at a distance of at least one millimeter from the perimeter of the frontal region facing said first entrance slit;
- the working first filament and the backup second filament comprise an iridium wire covered with an oxide deposit; and
- the oxide deposit is a layer of yttrium oxide or of thorium oxide.

Another subject of the invention is a mass spectrometer leak detector comprising an ionization cell such as described above.

BRIEF DESCRIPTION OF THE DRAWINGS

Other advantages and features will become clear on reading the description of the invention, and the appended drawings in which.

DETAILED DESCRIPTION OF THE INVENTION

In these figures, identical elements have been given the same reference numbers.

Figure 1:
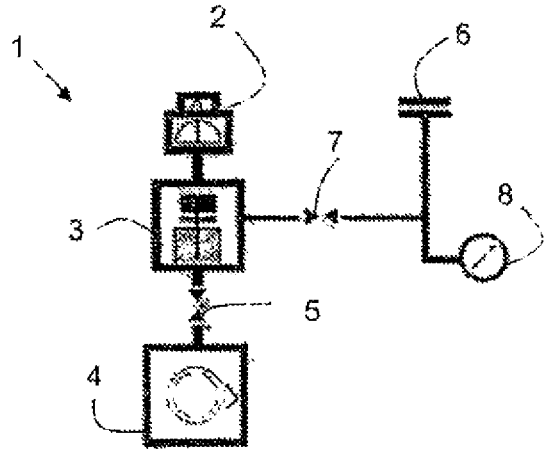
FIG. 1 is a schematic view of a leak detector.

FIG. 1 shows a leak detector 1 comprising a mass spectrometer 2 that uses a tracer gas such as helium ($He_3$ or $He_4$) or hydrogen ($H_2$).

The mass spectrometer 2 is connected to the inlet of a high-vacuum pump 3 the outlet of which is connected to the inlet of a roughing pump 4 via a first isolating valve 5. In this example, the gases to be analyzed 6, possibly containing the tracer gas revealing a leak, are sucked into the inlet of the high-vacuum pump 3 via a second isolating valve 7. Some of the gases to be analyzed 6 are then sampled by the mass spectrometer 2. The detector 1 may also comprise a pressure sensor 8 for determining the pressure of the gases in the piping connected to the high-vacuum pump 3, upstream of the second isolating valve 7.

Figure 2:
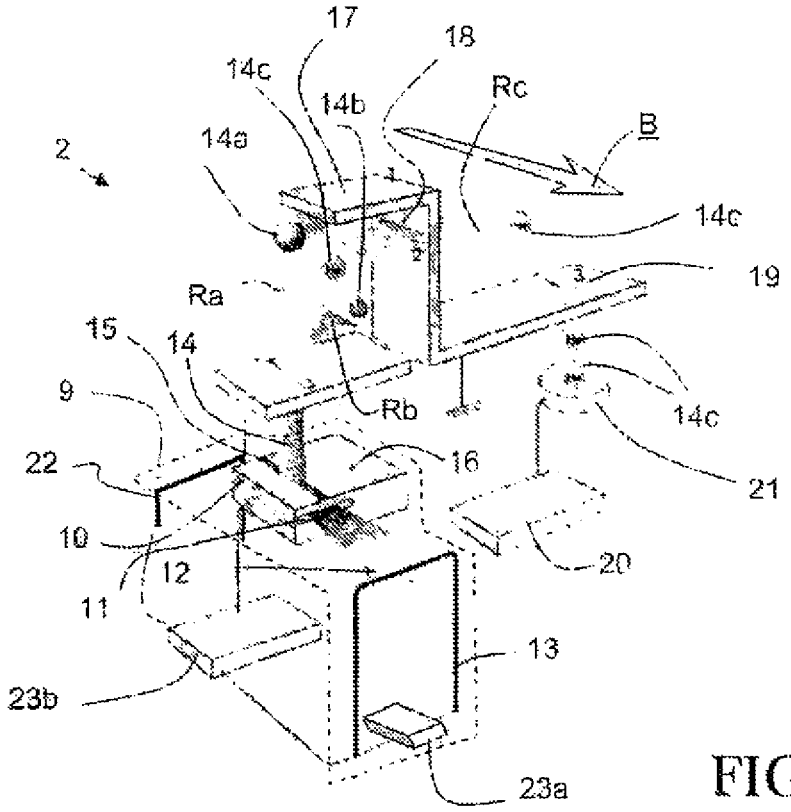
FIG. 2 is a schematic view of elements of a mass spectrometer according to a first embodiment.

More easily seen in FIG. 2, the magnetic-deflection mass spectrometer 2 comprises an ionization cell 9 and means for deflecting and selecting ionized particles 14*a*, 14*b*, 14*c*.

The ionization cell 9 comprises an ionization cage 10, in the form of a parallelepiped-shaped box, having a first entrance slit 11 for the passage of the electron beam 12. The ionization cell 9 also comprises a working first filament 13 that forms the electron beam 12 when it is powered. The working first filament 13 is placed facing the first electron entrance slit 11 of the ionization cage 10, so that a maximum number of electrons enter into the ionization cage 10.

The ionization cell 9 thus makes it possible to ionize the gases to be analyzed 6 by bombarding them with the electron beam 12, obtaining a beam 14 of ionized particles.

The ionization cage 10 also has an exit slit 15, on a side 16, for the passage of ionized particles 14*a*, 14*b*, 14*c* formed in the ionization cage 10. In FIG. 2, the side 16 containing the exit slit 15 corresponds to the top face of the ionization cage 10.

The deflection and selection means comprise for example a means for generating an electric field (not shown) for accelerating the ionized particles 14*a*, 14*b*, 14*c* and a means for generating a magnetic field (not shown), oriented substantially along the arrow B, such as permanent magnets, for deflecting the trajectory of the ionized particles 14*a*, 14*b*, 14*c*, with radii of curvature Ra, Rb, Rc, depending on the mass of the ionized particles.

Thus, the beam 14 of ionized particles, which contains ionized particles of different masses, divides into several beams 14*a*, 14*b*, 14*c*, each beam containing only ionized particles having the same m/e ratio (ratio of the atomic mass of the particle to the number of electrons lost on ionization). For example, ionized helium particles 14*c* are separated from the lighter ionized hydrogen particles 14*b*, the radius of curvature Rb of which is smaller, or from the heavier ionized nitrogen or oxygen particles 14*c*, the radius of curvature Rc of which is larger.

The total pressure in the chamber of the mass spectrometer 2 must be kept lower than $10^{-1}$ pascals so that the trajectories of the electrons and of the ionized particles are not disturbed by the residual molecules.

The deflection and selection means may also comprise a triode electrode 17 for collecting the ionized particles 14*a* the mass of which is greater than that of the tracer gas, and an aperture 18 for selecting the ionized particles 14*c* of tracer gas, and a retarding electrode 19 for eliminating noise caused by other ionized species.

The leak detector 2 also possesses an acquisition chain especially comprising a DC current amplifier 20 located downstream of a target 21 that receives the flux of incident ionized tracer gas particles 14*c* from the retarding electrode 19, so as to convert this flux into an electron current.

The ionization cell 9 furthermore comprises a backup second filament 22, intended to be powered, in the event of failure of the working first filament 13, so as to produce an electron beam instead of the working first filament 13. The backup filament 22 is placed opposite a second electron entrance slit placed on a face of the ionization cage 10 (not visible in FIG. 2).

The ionization cell comprises means for switching the power supply, allowing one of the two filaments to be selectively powered so as to ensure operating continuity by making it possible to switch the power supply from the working first filament 13 to the backup second filament 22 if the working filament 13 fails.

In FIG. 2 only the working first filament 13 is being powered, producing the electron beam 12 that is directed by the magnetic field B toward the corresponding first entrance slit 11 of the ionization cage 10. In the event of failure, the power supply for the working first filament 13 is cut and only the backup second filament 22 is powered, emitting a beam toward the corresponding second entrance slit of the ionization cage 10.

The filaments 13, 22 are powered, on the one hand, by an electrical current allowing them to be heated to incandescence. For example the filaments 13, 22 are connected to a current supply 23*a* providing a power of 14 W below 3 A. On the other hand, the filaments 13, 22 are supplied with a voltage by a voltage supply 23*b* of between 100 V and 300 V, connected to the filaments 13, 22 so that the potential of the ionization cage 10 is higher, by at least 100 V, than the potential of each filament 13, 22 (see FIG. 2).

The filaments 13, 22 may be made of iridium wire covered with an oxide deposit. The oxide deposit is for example a layer of yttrium oxide ($Y_2O_3$) or thorium oxide ($ThO_2$).

Alternatively, tungsten filaments 13, 22 are used. However, tungsten filaments have a very short lifetime when used at a low pressure of about $10^{-1}$ pascal compared to yttriated iridium filaments. In addition, yttriated iridium filaments better withstand the ingress of air.

Figure 4:
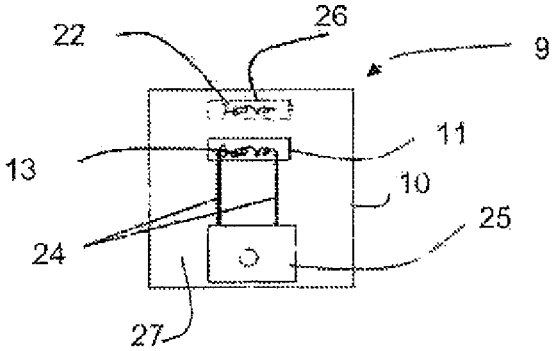
FIG. 4 is a schematic side view of an ionization cell.

As may be seen in FIG. 4, the filaments 13, 22 are for example fastened at their ends 24 into respective ceramic holders 25. Each ceramic holder 25 is mounted in the ionization cell 9 of the spectrometer 2 so that the filaments 13, 22 are placed opposite their respective entrance slit in the ionization cage 10.

The second entrance slit 26 is placed on a face of the ionization cage, outside of a frontal region F of the ionization cage 10 facing the first entrance slit 11. The frontal region F corresponds to the projection, onto the opposite face, of the area of the entrance slit 11, along the normal to the plane that contains it. Likewise, the backup second filament 22 is placed facing the second entrance slit 26, and therefore in a peripheral region separate from the frontal region F facing the first entrance slit 11.

Figure 3:
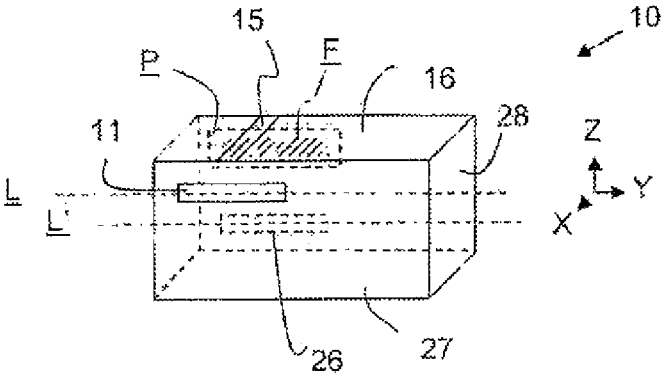
FIG. 3 is a schematic perspective view of an ionization cage.

The second entrance slit 26 is for example placed in a peripheral region defined by a perimeter P distant by at least one millimeter from and around the perimeter of the frontal region F facing the first entrance slit 11 (see for example FIG. 3).

Thus, in operation, with the working first filament 13 powered, the backup filament 22 is not altered by the working first filament 13.

In the event of failure of the working first filament 13, it is enough to cut the power from the first filament 13 and alternatively to power the backup second filament 22. The mass spectrometer 2 is then operational as soon as the backup second filament 22 has been sufficiently heated i.e. after about fifteen minutes.

On switching from the failed, working first filament 13 to the backup second filament 22, a stable and accurate measurement may then be rapidly obtained using the mass spectrometer 2.

The time required to switch filament is thus significantly reduced because interaction between the working first filament and the backup second filament is reduced.

The location and shape of each entrance slit 11, 26 are chosen depending on the location of the deflection and selection means. In the embodiment of the mass spectrometer in FIG. 2, the longitudinal axes L and L' of the first and the second entrance slits 11, 26 are substantially parallel to each other, and parallel to an edge of the ionization cage 10.

In the examples shown in FIGS. 2 to 8, the horizontal plane (X, Y) is defined by the plane containing the exit slit 15.

The first and the second entrance slits 11, 26 are for example placed on opposite faces 27, 28 of the ionization cage 10. There is then enough space at either end of the ionization cage 10 to arrange the filaments 13, 22 and their respective holders 25.

FIGS. 2 to 4 illustrate a first embodiment in which the first and second ends of the first and second entrance slits 11, 26 are contained in two planes respectively parallel to each other and parallel to a side face 28 of the ionization cage 10.

Thus in FIG. 2, the backup second filament 22 is placed in a peripheral region located below a frontal region F facing the first entrance slit 11. This example is more easily seen in FIG. 3 where the second entrance slit 26 is marked out by dashed lines on an opposite face 28 of the ionization cage 10, offset below the frontal region F facing the first entrance slit 11.

In contrast, in FIG. 4, marked out by dotted lines, the backup second filament 22 faces a second entrance slit 26 offset above a frontal region facing the first entrance slit 11 on an opposite face of the ionization cage 10.

Figure 5:
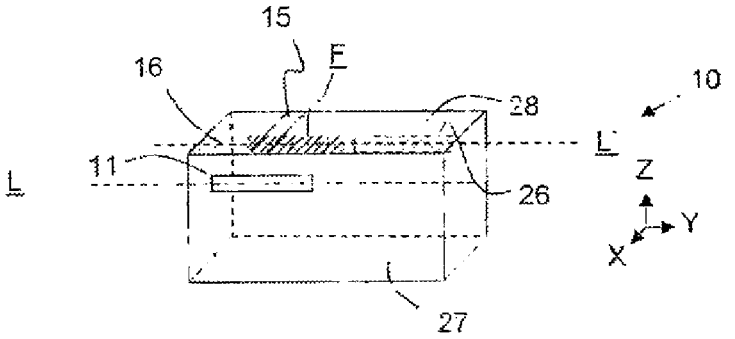
FIG. 5 is a schematic perspective view of an ionization cell according to a second embodiment.

FIG. 5 illustrates a second embodiment of the ionization cage 10. As in the preceding example, the longitudinal axes L and L' of the first and second entrance slits 11, 26 are substantially parallel to each other and parallel to a horizontal edge of the ionization cage 10. The first and second entrance slits 11, 26 are placed on opposite side faces 27, 28 of the ionization cage 10.

In this second embodiment, the first and second entrance slits 11, 26 define a plane substantially parallel to the plane defined by the side 16, of the ionization cage 10, containing the exit slit 15 for the passage of ionized particles.

Figure 6:
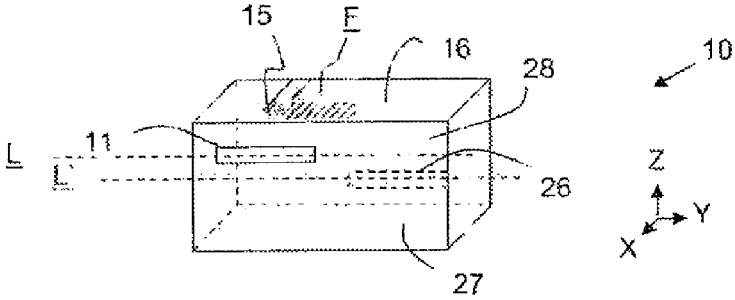
FIG. 6 is a schematic perspective view of an ionization cell according to a third embodiment.

FIG. 6 illustrates a third embodiment, similar to the two preceding examples, in which the peripheral region containing the second entrance slit 26 is offset from the frontal region F both along an axis Y parallel to the longitudinal axis L of the first entrance slit 11 and along an axis Z perpendicular to the longitudinal axis L of the first entrance slit 11. Thus in FIG. 6, the second entrance slit 26 is placed on the opposite face 28 and is offset, both horizontally along the horizontal axis Y and vertically along the vertical axis Z, from the frontal region F facing the first entrance slit 11.

Figure 7:
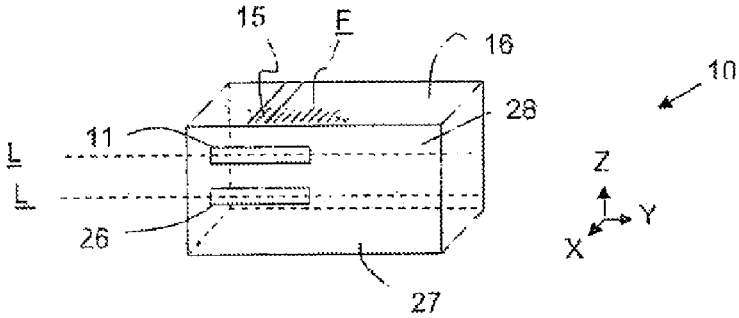
FIG. 7 is a schematic perspective view of an ionization cell according to a fourth embodiment.

According to a fourth embodiment shown in FIG. 7, the first and the second entrance slits 11, 26 are placed on the same face 27 of the ionization cage 10.

Moreover, depending on the location of the deflection and selection means, it is possible to imagine other embodiments of the entrance slits 11, 26.

Figure 8:
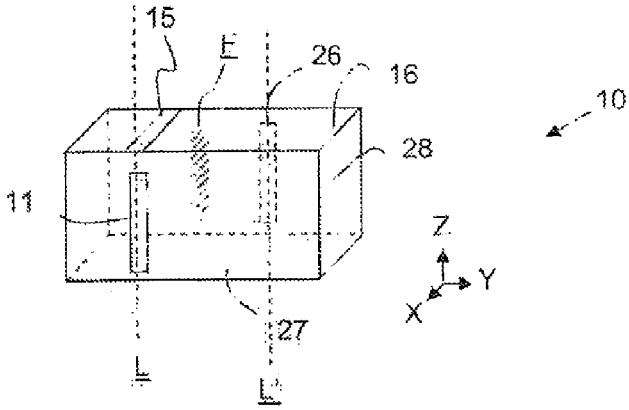
FIG. 8 is a schematic perspective view of an ionization cell according to a fifth embodiment.

FIG. 8 thus illustrates a fifth embodiment in which the longitudinal axes L and L' of the entrance slits 11, 26 are respectively parallel to the vertical axis Z. The entrance slits 11, 26 may be placed on opposite faces 27, 28 of the ionization cage 10. The first and second ends of the first and the second entrance slit 11, 26 are for example contained in two planes respectively parallel to each other.

The ionization cell 9 thus makes it possible to offset the backup second filament 22 from the frontal region F in which interactions may take place, so that the waiting time necessary to switch from the failed, working first filament 13 to the backup second filament 22 is reduced.

The invention claimed is:

1. An ionization cage (10) comprising first and second electron entrance slits (11, 26) in opposite sides thereof, and having an exit slit (15) for the passage of ionized particles (14*a*, 14*b*, 14*c*);

a working first filament (13), placed facing said first electron entrance slit (11) and operational when, intended to be powered-so-as to produce an electron beam (12), which is injected through said first electron entrance slit into a region inside said ionization cage maintained at a given pressure level to generate said ionized particles in a first ionization mode; and a backup second filament (22), placed facing said second electron entrance slit (26) and operational when powered to produce an electron beam which is injected through said second entrance slit into an adjacent region inside said ionization cage maintained at said given pressure level to ionize said particles in said first ionization mode, said second filament being powered, intended to be powered, in the event of failure of the working first filament (13), so as to produce the electron beam, said second electron entrance slit (26) being placed outside of a frontal region F facing said first electron entrance slit (11).

2. The ionization cell as claimed in claim 1, in which the longitudinal axes L and L' of said first and said second electron entrance slits (11, 26) are substantially parallel to each other and to an edge of said ionization cage (10).

3. The ionization cell as claimed in claim 2, in which said first and said second electron entrance slits (11, 26) define a plane substantially parallel to the plane defined by the side (16) containing the exit slit (15) for the passage of ionized particles (14*a*, 14*b*, 14*c*).

4. The ionization cell as claimed in claim 2, in which the first and second ends of said first and said second electron entrance slits (11, 16) are contained in two planes respectively parallel to each other and parallel to a side face (28) of the ionization cage (10).

5. The ionization cell as claimed in claim 1, in which said second electron entrance slit (26) is offset from the frontal region F, both along an axis parallel to the longitudinal axis L of said first electron entrance slit (11) and along an axis perpendicular to the longitudinal axis L of said first electron entrance slit (11).

6. The ionization cell as claimed in claim 1, in which said second electron entrance slit (26) is placed at a distance d of at least one millimeter from the perimeter of the frontal region F facing said first electron entrance slit (11).

7. The ionization cell as claimed in claim 1, in which the working first filament (13) and the backup second filament (22) comprise an iridium wire covered with an oxide deposit.

8. The ionization cell as claimed in claim 7, in which the oxide deposit is a layer of yttrium oxide or of thorium oxide.

9. A mass spectrometer leak detector comprising an ionization cell (9) as claimed in claim 1.

10. An ionization cell, for a mass spectrometer (2), comprising:

an ionization cage (10) comprising first and second electron entrance slits (11, 26) in opposite sides thereof, and having an exit slit (15) for the passage of ionized particles (14*a*, 14*b*, 14*c*);

a working first filament (13), placed facing said first electron entrance slit (11) and operational when powered to produce an electron beam (12) which is injected through said first electron entrance slit into a region inside said ionization cage maintained at a given pressure level; and a backup second filament (22), placed facing said second electron entrance slit (26) and operational when powered to produce an electron beam which is injected through said second entrance slit into an adjacent region inside said ionization cage maintained at said given pressure level, said second filament being powered in the event of failure of the working first filament (13), said second electron entrance slit (26) being placed outside of a frontal region F facing said first electron entrance slit (11).

11. An ionization cell, for a mass spectrometer (2), comprising:

an ionization cage (10) comprising first and second electron entrance slits (11, 26) in opposite sides thereof and both in communication with a common region of an interior of said cage having a given pressure level, and having an exit slit (15) for the passage of ionized particles (14*a*, 14*b*, 14*c*);

a working first filament (13), placed facing said first electron entrance slit (11), intended to be powered so as to produce an electron beam (12); and a backup second filament (22), placed facing said second electron entrance slit (26), intended to be powered, in the event of failure of the working first filament (13), so as to produce the electron beam, said second electron entrance slit (26) being placed outside of a frontal region F facing said first electron entrance slit (11).

* * * * *